United States Patent [19]

Brooks

[11] 4,121,394

[45] Oct. 24, 1978

[54] METHOD OF INSTALLING A PANE TO AN EXISTING GLAZED SYSTEM

[75] Inventor: Marvin V. Brooks, Kokomo, Ind.

[73] Assignee: PPG Industries, Inc., Pittsburgh, Pa.

[21] Appl. No.: 828,064

[22] Filed: Aug. 26, 1977

[51] Int. Cl.[2] ..... E06B 3/28

[52] U.S. Cl. ..... 52/203; 52/479; 52/741

[58] Field of Search ..... 52/202, 616, 397, 398, 52/741, 498, 203

[56] References Cited

U.S. PATENT DOCUMENTS

| | | | |
|---|---|---|---|
| 3,872,638 | 3/1975 | DiFazio | 52/398 X |
| 3,928,953 | 12/1975 | Mazzoni et al. | 52/616 X |
| 3,955,331 | 5/1976 | Williams | 52/397 |
| 3,971,178 | 7/1976 | Mazzoni et al. | 52/616 X |

*Primary Examiner*—Price C. Faw, Jr.
*Assistant Examiner*—Carl D. Friedman
*Attorney, Agent, or Firm*—Donald Carl Lepiane

[57] ABSTRACT

A pane having a flowable, moisture-resistant adhesive on its inner marginal edge portions is positioned on an existing glazed unit mounted in a fenestration. An elongated member having a grooved form therein is mounted to the fenestration walls or framing with the groove facing the outer marginal edge portions of the pane. Thereafter, a resilient glazing strip is urged in the groove to bias the pane toward the existing glazing, to flow the adhesive, to effect a hermetic seal between the pane and the glazed unit and to provide an acceptable closure between the applied elongated member and the installed pane.

12 Claims, 4 Drawing Figures

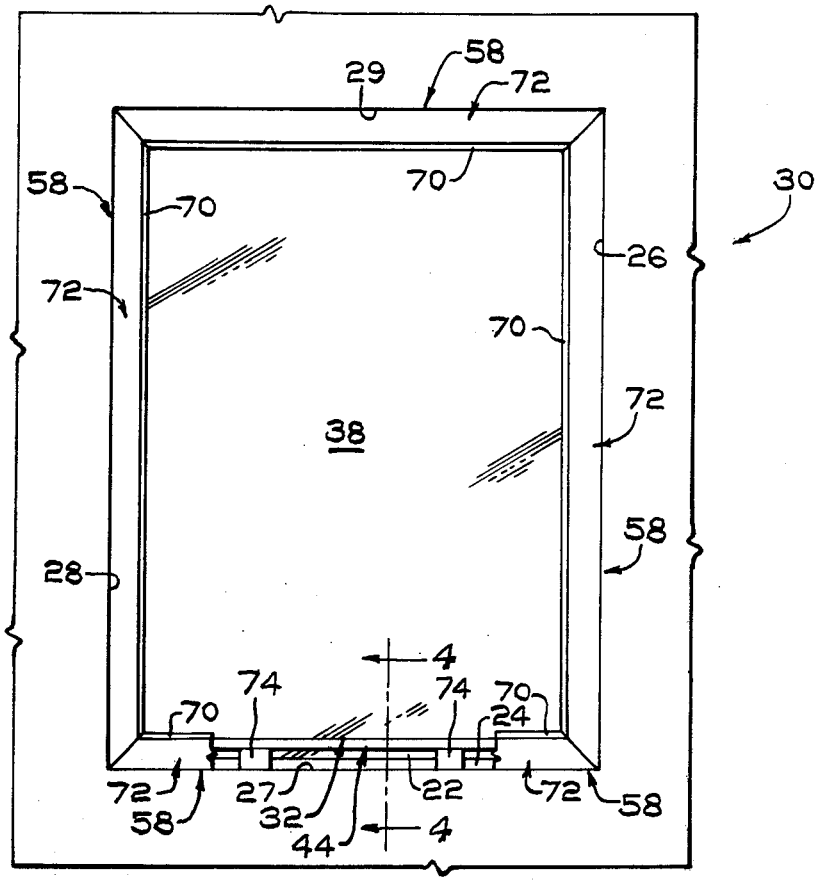
FIG. 3
FIG. 4
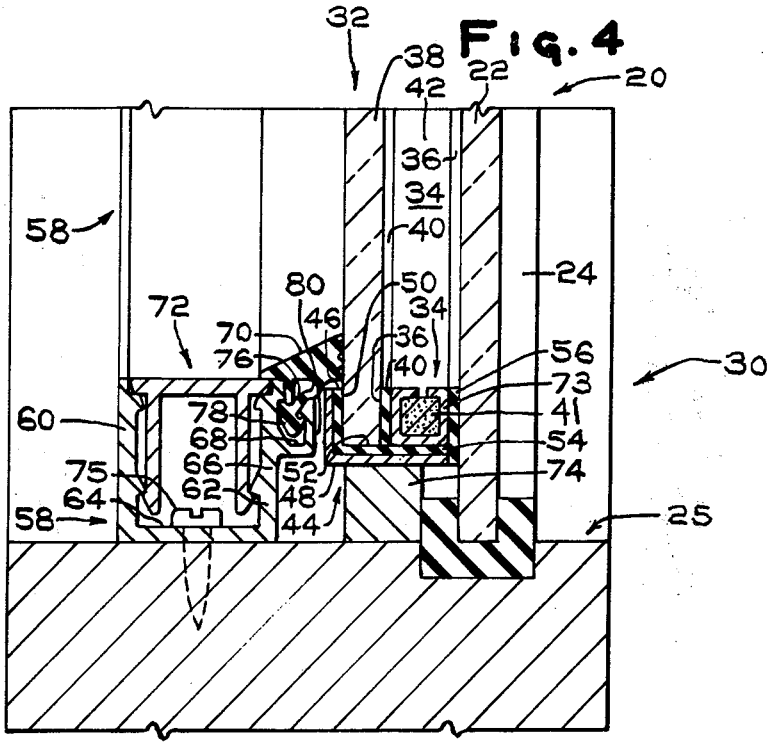

METHOD OF INSTALLING A PANE TO AN EXISTING GLAZED SYSTEM

BACKGROUND OF THE INVENTION

1. Field of the Invention

This invention relates to a method of installing a pane to an existing glazed unit which will provide an insulated sealed airspace therebetween.

2. Discussion of the Technical Problem

U.S. Pat. No. 3,971,178 teaches a method of adding a pane to an existing glazing installation to provide an insulating, sealed airspace therebetween.

In general, the pane includes a spacer mounted on marginal edges of the pane by a moisture-impervious sealant. A moisture-impervious adhesive between the spacer and the existing glazing is flowed under pressure to form an insulated sealed airspace between the pane and the existing glazing.

U.S. Pat. No. 3,971,178 in column 7, lines 54–61, teaches that pressure for flowing the adhesive may be applied by clamping facilities carried by glass holding equipment; by special leverage facilities coacting with the frame or wall structure; or to impose a vacuum in the newly created airspace for sufficient time to permit the moisture-impervious adhesive to flow and seal. Both the vacuum and mechanical facilities may be used simultaneously.

U.S. patent application Ser. No. 771,517 filed on Feb. 24, 1977, in the name of Richard R. Lewchuk for a glazing tool teaches the use of a plurality of tools each having a plunger to flow the adhesive between the pane and the existing glazing. In general, the pane is positioned against the existing glazing, and a plurality of the tools are detachably secured to the frame of the existing glazing. Thereafter, the plungers are biased toward the marginal edge portions of the pane to flow the moisture-impervious adhesive.

Although the above techniques are acceptable, they each require the mounting and removal of pressure applying tools. It would be advantageous, therefore, to provide a method of installing panes to an existing glazed unit to form an insulated airspace therebetween that does not require the mounting and demounting of pressure applying tools.

SUMMARY OF THE INVENTION

This invention relates to a method of installing a pane having a first major surface and a second opposite major surface to an existing glazed unit mounted in a fenestration. An adhesive is provided between the first major surface of the pane and the existing glazed unit. An elongated member is secured on the fenestration in spaced relation to the second major surface of the pane. Thereafter, biasing facilities are inserted between the elongated member and the second surface of the pane to urge the pane toward the existing glazed unit to flow the adhesive therebetween.

This invention also relates to an improved architectural glazing of the type having an existing glazed unit mounted in a fenestration of a building wall structure and a pane mounted on the existing glazed unit by a flowable adhesive, flowable under a predetermined pressure at room temperature. The improvement includes a rigid elongated member having a groove therein for receiving a glazing strip secured to fenestration walls and a glazing strip inserted in the groove to bias the pane toward the existing glazed unit. The strip when inserted in the groove has a force equal to or greater than the force required to flow the adhesive.

BRIEF DESCRIPTION OF THE DRAWING

FIG. 3 is a view similar to FIG. 1 illustrating a pane mounted on the existing glazing in accordance to the teaching of the invention and having portions removed for purposes of clarity;

FIG. 4 is a view taken along lines 4—4 of FIG. 3.

DESCRIPTION OF THE INVENTION

Figure 1:
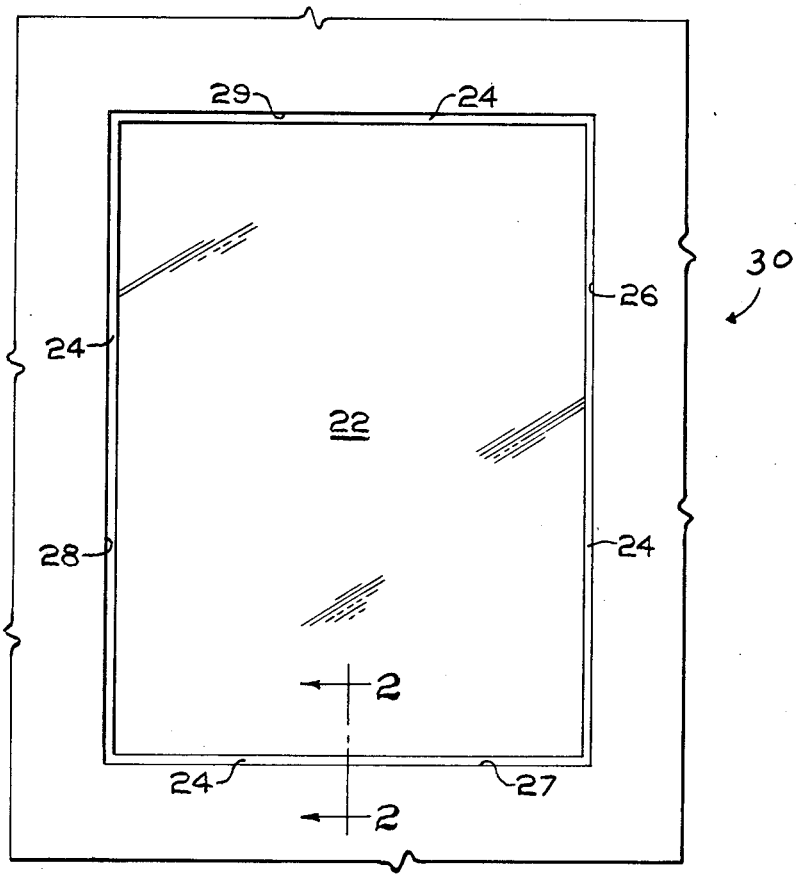
FIG. 1 is a frontal view of a conventional existing glazed unit mounted in a fenestration formed in a wall structure on which the invention is practiced.
Figure 2:
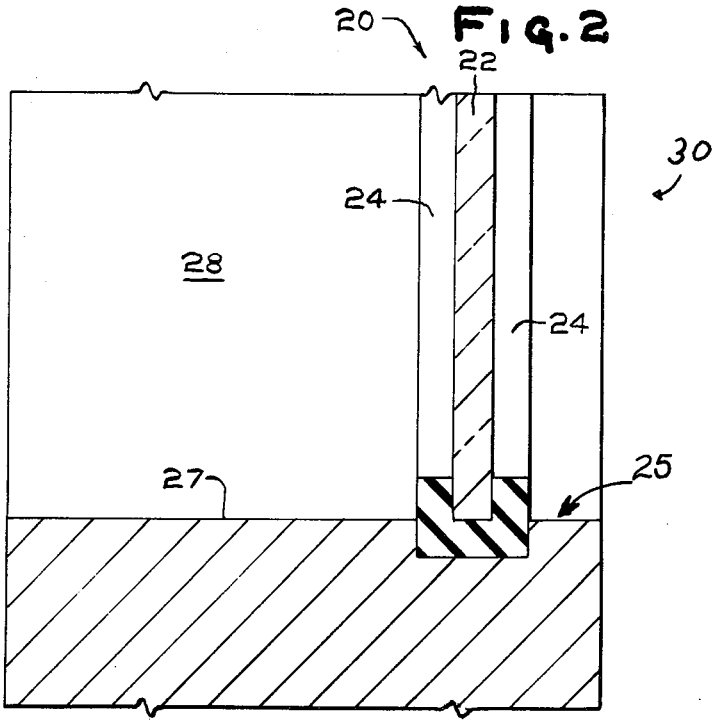
FIG. 2 is a view taken along lines 2—2 of FIG. 1.

With reference to FIGS. 1 and 2, there is shown a single glazed window installation of window unit 20 that includes a glass sheet 22 mounted in a frame 24 in any conventional manner. The window unit 20 is mounted in a fenestration 25 in any conventional manner and defined by fenestration walls 26–29. The fenestration 25 and window unit 20 which form part of a building wall structure 30 is not limiting to the invention.

The term "fenestration" as used herein and in the claims includes the frame 24 and interior trim elements on walls 26–29. As can be appreciated by those skilled in the art, the walls 26–29 may be made of metal, marble, wood or plasterboard.

Referring now to FIGS. 3 and 4, there is shown a pane 12 that may be used in practice of the invention. With specific reference to FIG. 4, the pane 32 includes a spacer 34 mounted to inner marginal edges 36 of a glass sheet 38 by an adhesive 40. Although not limiting to the invention, the adhesive 40 is preferably a moisture-resistant sealant of the type used in a multiple glazing art.

The expressions "moisture-resistant", "barrier against moisture penetration", and "hermetic seal", as used herein, refer to an ability to prevent passage of water vapor to such an extent that the subject material or structure is capable of being utilized in a multiple glazed architectural installation. To qualify for such architectural use, the material or structure should present enough of an obstacle to water vapor transmission as to preclude condensation of water vapor in the interior of a multiple glazed unit at temperatures down to about 0° F. (i.e., about $1.77 \times 10^{-5}$ grams of water per cubic inch of air in the unit) and preferably lower over a period of several years. The time period required is at least about 3 to about 5 years but preferably is at least about 10 years and in optimum cases is at least about 20 years.

The amount of water vapor penetration depends not only on the inherent moisture vapor transmission of the material employed as the obstacle but also on the dimension (e.g., thickness) of the obstacle in the path of water vapor penetration. Because visual aesthetics must be considered in regard to architectural glazing, it is desirable to minimize the dimensions of the water vapor barriers. Thus, materials having a relatively low moisture vapor transmission are preferred. For this reason, it is generally preferred that the materials used for the moisture barriers in multiple glazing have a moisture vapor transmission of less than about 15 grams (preferably less than about 6 grams) for 24 hours per square meter per mil thickness at 100° F. and 90% relative humidity as determined by A.S.T.M. E-96-66E. Desiccants are often included in multiple glazed units to absorb moisture vapor in the airspace; and when a desiccant is employed, the requirements for moisture barriers may be relaxed by an amount corresponding to the water absorbing capacity of the desiccant.

With continued reference to FIG. 4, the spacer 34 preferably has a desiccant 41 therein which communicates with airspace 42 between the glass sheet 38 of the pane 32 and the glass sheet 22 of the glazing 20 in any conventional manner. A composite strip 44 including a moisture-resistant sealing or adhesive 46 on a bendable, flexible tape 48 is mounted on outer marginal edge portions 50 and peripheral edge portion 52 of the glass sheet 38 of the pane 32 and outer peripheral edges 54 of the spacer 34.

The pane 32 as shown in FIG. 4 is similar to that shown in FIG. 15 of U.S. Pat. No. 3,971,178 and in FIG. 8 of U.S. Pat. No. 3,928,953. For further discussions of the pane 32 that may be used in the practice of the invention, reference may be made to the teachings of U.S. Pat. Nos. 3,971,178 and 3,928,953, which teachings are hereby incorporated by reference.

As will become apparent, the invention is not limited to the construction of the pane 32 and any of the pane construction taught in U.S. Pat. Nos. 3,971,178 and 3,928,953 as well as the pane taught in U.S. patent application Ser. No. 594,907, filed July 10, 1975, in the name of John P. Bologna for "Glazing Unit and Method of Reducing Transmissions of Solar Energy" may be used in the practice of the invention. The teachings of the above-identified U.S. patent application are hereby incorporated by reference.

As used herein and in the claims, the term "pane" refers to a sheet having a spacer adhered thereto as shown for the pane 32 in FIG. 4 or a sheet without a spacer.

The pane 32 is mounted on the sheet 22 of the glazing installation 20 by flowing a layer 56 of adhesive between the spacer 34 and sheet 22 of the glazing installation 20. Preferably, the composition and width of the adhesive layer 56 are selected so as to form a moisture-resistant barrier when bonded to the glass sheet 22 in a manner to be discussed below. The adhesive layer 56 may be a polysulfide or silicone but is preferably a room temperature curable or vulcanizable material that will cold flow to form a moisture-resistant seal and a resilient structural bond. Butyl-based mastics are preferred such as the two components room temperature curable butyl-based mastic taught in U.S. Pat. No. 3,791,910, which teachings are hereby incorporated by reference.

On-site assembly is substantially expedited by providing a tacking non-curable composition for the adhesive layer 56. A non-curing moisture-resistant adhesive that may be used in the practice of the invention has the following composition:

| Component | (Weight %) |
|---|---|
| polyisobutylene (viscosity average molecular weight 75,000 - 100,000) | 15-50 |
| polyisobutylene (viscosity average molecular weight 8,000 - 10,000) | 10-45 |
| carbon black | 10-45 |
| silica pigment | 5-15 |
| zirconium orthosilicate | 5-15 |
| polybutene | 20-50 |
| zinc oxide | 0-5 |
| gamma-glycidoxy-propyltrimethoxysilane | 0-5 |

The discussion will now be directed to the features of the invention for flowing the adhesive layer 56 to form a moisture-resistant barrier to provide the insulated sealed airspace 42.

With reference to FIGS. 3 and 4, an elongated rigid member 58 is secured to each of the fenestration walls 26-29 in any conventional manner. As shown in FIG. 4, but not limiting to the invention, the members 58 each have a pair of spaced wall members 60 and 62 integral with a base 64 such that the member 58 has a generally U-shaped cross-sectional configuration. The outer surface of the wall member facing the pane 32; e.g., outer surface 66 of the wall member 62 has a groove 68 formed therein for receiving a strip 70. The strip 70 biases the outer marginal edge portions 50 of the glass sheet 38 of the pane 32 toward the glass sheet 22 of the existing glazing 20 to flow the adhesive layer 56 therebetween. The strip 70 may be made of any material that when inserted in the groove 68 biases the pane 32 to flow the adhesive layer 56. For example, the strip 70 may be made of plastic, metal or wood but is preferably made of rubber or synthetic rubber compounds because such compounds are resilient and will not mar the surfaces of the glass sheet 38 when the strip is inserted into the groove 68 of the member 58.

The strip 70 should apply sufficient pressure to the glass sheet 38 of the pane 32 to flow the adhesive layer 56 to form the insulated sealed airspace 42. In general, the parameters to be considered to provide the insulated sealed airspace are (1) the spaced distance between the member 58 and outer surfaces of the glass sheet 38 of the pane 32; (2) the width of the strip 70; and (3) the durometer of the strip 70. Decreasing the spaced distance between the member 58 and outer surfaces of the glass sheet 38 of the pane 32 while keeping the remaining parameters constant increases the pressure on the adhesive layer 56 and vice versa. Increasing the width of the strip 70 while maintaining the remaining parameters constant increases the pressure on the adhesive layer 56 and vice versa. Increasing the durometer of the strip 70 while maintaining the remaining parameters constant increases the pressure on the adhesive layer 56 and vice versa.

The pressure applied to the adhesive layer 56 also depends on the flow characteristics of the adhesive layer. For example, if the pressure required to flow the adhesive increases, the pressure applied to flow same should be increased and vice versa. It is recommended that adhesives which flow at room temperature under pressures of about 5 to 10 pounds per square inch (285-570 grams per square centimeter) be used.

Although not limiting to the invention but recommended for aesthetic appeal, a cap 72 is mounted on the elongated member 58 as shown in FIG. 4. In the practice of the invention, it is recommended that the elongated member 58 be mounted on a surface having structural integrity so that the member 58 is secured in position.

Practicing the instant invention, it is now possible to mount a pane to an existing glazed unit to provide an insulated unit without the use of tools as taught in the prior art. Further, the instant invention provides a finished insulated unit that has aesthetic appeal. The strip 70 also provides an airtight seal which improves heat loss characteristics of the finished product by providing a dead airspace around the perimeter of the pane 32.

It can now be appreciated that the glass sheets 38 and 22 of the pane 32 and glazing installation 20, respectively, may be coated to reduce passage of solar energy and/or infrared energy. Further, the pane 38 may include a plurality of glass sheets. Still further, other sheet material; e.g., metal, plastic or wood, may be used in the practice of the invention.

DETAILED DESCRIPTION OF THE INVENTION

The instant invention is practiced to install pane 32 (see FIGS. 3 and 4) to an existing glazed unit 20 (see FIGS. 1 and 2) to provide an insulated sealed airspace 42 (shown in FIG. 4) therebetween.

With reference to FIG. 1, the existing glazed unit installation 20 includes a glass sheet 22 mounted in a frame 24 in any conventional manner. The frame 24 is mounted in any conventional manner in fenestration walls 26–29 formed in wall structure 30. Each of the fenestration walls 26–29 has a depth of about 3 inches (7.6 centimeters) with fenestration walls 26 and 28 having a height of about 5 feet (1.5 meters) and fenestration walls 27 and 29 having a length of about 4 feet (1.2 meters). The glass sheet 22 has an exposed perimeter of about 47 inches (1.19 meters) by about 59 inches (1.49 meters).

With reference to FIG. 4, the pane 32 includes a glass sheet 38 having a thickness of about 3/16 inch (9.48 centimeters), a width of about 46¼ inches (1.17 meters) and a height of about 58¼ inches (1.48 meters). A spacer 34 having peripheral dimensions corresponding to those of pane 32 and with a thickness of about ½ inch (1.27 centimeters) and a height of about ⅜ inch (0.95 centimeter) is mounted on inner marginal edges 36 of the glass sheet 38 by a layer 40 of a moisture-resistant adhesive of the type taught in U.S. Pat. No. 3,971,178. The spacer 34 is made of welded hollow sections having desiccant 41 therein and is of the type taught in U.S. Pat. No. 2,684,266, which teachings are hereby incorporated by reference. The composite strip 44 includes an aluminum tape 48 about 0.008 inch (0.02 centimeter) thick adhered to the outer marginal edge portions 50 and peripheral edge portions 52 of the glass sheet 38 and peripheral edge portions 54 of the spacer 34 by a layer 46 of a moisture-impervious adhesive. The construction of the pane 32 is similar to the pane shown in FIG. 15 of U.S. Pat. No. 3,971,178.

With continued reference to FIG. 4, a layer 56 of a moisture-resistant adhesive flowable at room temperature under pressure of about 6 pounds per square inch (342 grams per square centimeter) is provided on outer surface 73 of the spacer 34. The adhesive layer 56 has a thickness of about 0.10 inch (0.25 centimeter) and is of the type taught in U.S. Pat. No. 3,971,178.

A pair of neoprene spacer blocks 74 having a height of about ⅜ inch (0.95 centimeter), a length of about 4 inches (10.2 centimeters) and a width of about 11/16 inch (1.75 centimeters) are positioned on the fenestration wall 26 as shown in FIG. 3. The pane 32 rests on the spacer blocks 74 and is urged against the glass sheet 22 in the frame 24.

An extruded aluminum member 58 having a pair of spaced wall members 60 and 62 integral with a base 64 to give the member 58 a generally U-shaped cross-sectional configuration is mounted on the fenestration walls 26–29 by screws 75 (one shown in FIG. 4). The ends of the members 58 may be either mitered or square cut to give the appearance of a frame as shown in FIG. 3. The member 58 has a nominal wall thickness at any given point of about 3/32 inch (0.24 centimeter). The base 64 of the member 58 has a width of about ¾ inch (1.9 centimeters) with the wall member 60 and 60 extending about ⅞ inch (2.21 centimeters) above the base 64 of the elongated members 58. A groove 68 formed on the wall member 62 of the members 58 and has ledges 78 for securing strip 70 therein. Surface 80 of groove 68 is spaced about 1/16 inch (0.16 centimeter) from adjacent surface of the composite strip 44 as shown in FIG. 4.

A cap 72 is secured between the spaced wall member 60 and 62 in any conventional manner. However, a snap-fit, as shown in FIG. 4, is preferable from an aesthetic point of view.

The strip 70 is made of rubber compounds having a durometer reading of about 60 and is sized to apply pressure of about 6–10 pounds per square inch (342–570 grams per square centimeter) on the adhesive layer 56 when inserted in the groove 68 of the elongated members 58. Thereafter, the strip 70 is inserted in the groove 68 and applies pressure to the outer surface of the glass sheet 38 of the pane 32 to flow the adhesive layer 56 to provide a sealed airspace 42 between the glass sheets 38 and 22 of the pane 32 and the existing glazing 20, respectively.

As can be appreciated, the instant invention eliminates the need for special tools, provides a finished installation and reduces heat loss characteristics of the finished unit. Further, as can be appreciated, the above example is merely presented to illustrate one embodiment of the invention and the invention is not limited thereto.

What is claimed is:

1. A method of installing a pane having a first major surface and a second major surface to an existing glazed unit mounted in a fenestration, comprising the steps of:

placing the pane in juxtaposition to the existing glazed unit with an adhesive flowable under a predetermined pressure between the first major surface of the pane and adjacent surface of the existing glazed unit;

securing an elongated member having retaining means on a surface thereof on the fenestration with the surface having the retaining means spaced a predetermined distance from the second major surface of the pane;

providing a resilient biasing means having a biasing pressure when mounted in the retaining means of the secured elongated member at least as great as the predetermined pressure required to flow the adhesive; and urging the biasing means in the retaining means of the secured elongated member to compress the resilient means and to capture the resilient means in the retaining means which urges the pane toward the existing glazed unit to apply a pressure to the adhesive therebetween greater than the predetermined pressure required to flow the adhesive.

2. The method as set forth in claim 1 wherein the pane includes a desiccative spacer secured to the marginal edge portions of the first surface of the pane by a moisture-resistant adhesive and said placing step includes the step of:

applying a room temperature flowable, moisture-resistant adhesive to outer marginal edge portions of the spacer.

3. The method as set forth in claim 1 wherein the retaining means is a groove formed in the elongated member, the biasing means is a resilient strip and said urging step includes the step of:

inserting the resilient strip in the groove to bias the pane toward the existing glazed unit to flow the adhesive therebetween.

4. The method as set forth in claim 3 wherein the fenestration includes a frame mounting the glazed unit and the elongated member is mounted on the frame.

5. The method as set forth in claim 1 wherein (1) the fenestration includes a pair of opposed side wall portions, an upper wall portion and a bottom wall portion, (2) the retaining means is a groove formed in the elongated member, and (3) the resilient means is a resilient strip, and wherein:

said placing step includes the step of providing a room-temperature flowable adhesive on marginal edge portions of the first surface of the pane;

said securing step includes the step of mounting the elongated member on the opposed side wall portions, the upper wall portions and the bottom wall portions of the fenestration with the groove spaced from the second surface of the pane; and said urging step includes the step of inserting the resilient strip in the groove in biasing contact with marginal edge portions of the pane.

6. The method as set forth in claim 5 wherein the pane includes a desiccative spacer mounted on marginal edge portions of the first surface and a room-temperature, moisture-resistant adhesive flowable under the predetermined pressure is provided on the exposed marginal edge portions of the spacer.

7. The method as set forth in claim 1 wherein at least the pane or existing glazed unit includes a glass sheet.

8. In an architectural glazing of the type having an existing glazed unit mounted in fenestration of a building wall structure and a pane mounted on the existing glazed unit by an adhesive flowable under a predetermined pressure, the improvement comprising:

a rigid elongated member having retaining means formed in a surface, said member mounted on the fenestration with the surface having the retaining means spaced a predetermined distance from marginal edge portions of outer surface of the pane; and a resilient biasing strip captured by the retaining means and compressed by the pane and said member to exert a biasing pressure on the pane at least equal to the predetermined pressure required to flow the adhesive.

9. The architectural glazing as set forth in claim 8 wherein the glazed unit is mounted in a frame and said elongated member is mounted on said frame.

10. The architectural glazing as set forth in claim 8 wherein the adhesive is a room temperature flowable moisture-resistant adhesive mounted on outer marginal edge portions of a desiccative spacer adhered to the marginal edge portions of the pane by a moisture-resistant adhesive.

11. The architectural glazing as set forth in claim 8 wherein the adhesive is a room-temperature flowable adhesive mounted on the marginal edge portions of the inner surface of the pane.

12. The architectural glazing as set forth in claim 8 wherein at least the pane or existing glazed unit includes a glass sheet.

* * * * *